US006409320B1

(12) United States Patent
Kurihara et al.

(10) Patent No.: US 6,409,320 B1
(45) Date of Patent: Jun. 25, 2002

(54) INK JET PRINTER HEAD AND INK JET PRINTER

(75) Inventors: Kazuaki Kurihara; Michinori Kutami, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/459,335

(22) Filed: Dec. 13, 1999

(30) Foreign Application Priority Data

Dec. 15, 1998 (JP) ..... 10-356186

(51) Int. Cl.[7] ..... B41J 2/045
(52) U.S. Cl. ..... 347/68
(58) Field of Search ..... 347/68, 70, 71, 347/72

(56) References Cited

U.S. PATENT DOCUMENTS 5,332,942 A * 7/1994 Rennex ..... 310/328
5,402,159 A * 3/1995 Takahashi et al. ..... 347/72
5,410,210 A * 4/1995 Sato et al. ..... 310/363
5,446,485 A * 8/1995 Usui et al. ..... 347/72
5,639,508 A * 6/1997 Okawa et al. ..... 347/72
5,775,715 A * 7/1998 Vandergrift ..... 280/602
6,186,619 B1 * 2/2001 Usui et al. ..... 347/72

OTHER PUBLICATIONS

Patent Abstracts of Japan, JP Hei 03–010846 (A), Jan., 1991.
Patent Abstracts of Japan, JP Hei 08–192513 (A), Jul., 1996.

* cited by examiner

*Primary Examiner*—John Barlow
*Assistant Examiner*—Ly T Tran
(74) *Attorney, Agent, or Firm*—Armstrong, Westerman and Hattori, LLP

(57) ABSTRACT

The ink jet printer head comprises: a piezoelectric device 10 including a stress removing electrode 14, a stress removing piezoelectric layer 16 formed on the stress removing electrode 14, and a drive layers formed of drive electrodes 18 and a piezoelectric layer 20 formed on the stress removing piezoelectric layer 16, the drive layer being divided in a plurality of drive portions 222 and a plurality of non-drive portions 26 by grooves 24 which arrive at the stress removing piezoelectric layer 16; and a channel plate 40 jointed to the piezoelectric device 10 and having discrete ink channels 42 formed in parts thereof opposed to the drive portions 22, corresponding to nozzles for jetting ink.

18 Claims, 9 Drawing Sheets

INK JET PRINTER HEAD AND INK JET PRINTER

BACKGROUND OF THE INVENTION

The present invention relates to an ink jet printer head using a piezoelectric device to jet ink, and an ink jet printer.

Ink jet printers are printers of the type that liquid ink is jetted into air in droplets, a liquid column or a spray to print letters, graphs, pictures, etc. on recording papers. It has motivated practice of the ink jet printers that the ink jet printers can have noises reduced, be smaller-size and lightened.

Heads for use in the ink jet printers are mainly of bubble type which generates air bubbles generated by a heater in a pressure chamber to jet ink from a nozzle by a force of the air bubbles, and piezoelectric type which has an oscillation plate on the bottom of a pressure chamber to press the oscillation plate by a piezoelectric material to jet ink from a nozzle.

The bubble type of these two types has limits to printing speed and print quality because performance of the head is determined substantially by characteristics of ink, which makes it difficult to meet higher speed and higher print quality. On the other hand, the piezoelectric type is expected to have higher performance than the bubble type because the piezoelectric type can easily meet higher speed, control ability and ink characteristics but has disadvantages of the complicated structure and being expensive.

As an ink jet printer head which solves these disadvantages of the piezoelectric type the applicant proposes in Japanese Patent Laid-Open Publication No. 192513/1996 a piezoelectric type ink jet printer head comprising a channel plate 110 for defining a plurality of discrete ink channels 112 and a piezoelectric device 100 which is parts of the walls of the discrete ink channels 112, which are connected with each other (see FIG. 8). Because this structure is very simple and has a small number of parts, this type could be inexpensive comparably with the bubble type. However, drive portions 106 of the piezoelectric device 100 opposed to the discrete ink channels 112 are restricted by the side surfaces and the bottom surfaces, whereby the drive portions 106 have poor displacing efficiency. In addition, each drive portions 106 is affected by the other drive portions 106, whereby a stroke of a displacement amount is large. The characteristics of the ink jet printer head are not satisfactory for an ink jet printer head.

Japanese Patent Publication No. 33087/1995 discloses an ink jet printer head having respective drive portions 140 divided by grooves 138 to thereby improve displacement efficiency (see FIG. 9). In this ink jet printer head, drive portions 140 of a piezoelectric device 130 corresponding to discrete ink channels 152 are separated by the grooves 138 and accordingly are not little restricted in displacement, so that large displacement amounts can be obtained in comparison with those of the conventional head shown in FIG. 8. However, on other hand, the bottoms of the drive portions 140 are connected to the base of the piezoelectric device 130, and disadvantageously displacements of the drive portions 140 are conducted to the other drive portions 140.

That is, when a voltage is applied to the drive portions 140, the drive portions 140 are extended upward by the vertical piezoelectric effect while being diminished widthwise by the lateral piezoelectric effect. Displacements of the drive portions 140 by the lateral piezoelectric effect, the bottoms of which are not separated from the base of the piezoelectric device 130 therebelow, cause the base contacting the drive portions 140 to diminish. Accordingly, a tensile stress is exerted to the rest part of the base and restricts displacements of the other drive portions 140. Thus, as a number of drive pins is larger, the drive pins restrict displacements each other to thereby vertical displacement amounts for pressing the respective ink channels 152 are decreased. In addition, displacements by the lateral piezoelectric effect become a huge stress at the forward ends of the grooves 138 due to stress concentration, which results in breaking devices and in decreasing reliability.

Furthermore in the head shown in FIG. 9, the piezoelectric layers 136 of the drive portions 140 are sandwiched by the drive electrodes 134. Generally adhesion strength between piezoelectric materials and electrode materials is low, and the electrode material and the piezoelectric material tend to peel off each other in their interface when the grooves 138 are processed. The same peeling tends to occur while being driven or after driven due to stresses generated when driven. Reliability is poor.

Additionally in the head shown in FIG. 9, the drive electrodes 134 and the piezoelectric layers 136 are formed not considering the drive portions 140 and the non-drive portions 142, and are divided by processing the grooves 138, and accordingly the drive electrodes 134 are also formed in the non-drive portions 140. A tensile stress is applied to the non-drive portions 142 when a voltage is applied to the drive portions 140 to press the ink channels, and the peeling tens to take place in the electrodes-ceramics interfaces whose strength is low.

For higher nozzle density it is necessary that the non-drive portions 142 have a width as small as possible, and the presence of the drive electrodes 134 in the non-drive portions 142 is a problem in view of reliability in processing the grooves 138 and driving.

As described above, the conventional ink jet printer heads are not satisfactory to meet both requirements of reduction of crosstalk and higher reliability.

SUMMARY OF THE INVENTION

An object of the present invention is to provide a ink jet printer head having little crosstalk, high reliability and high performance, and an ink jet printer of high performance using the ink jet printer head.

The above-described object is achieved by an ink jet printer head comprising: a piezoelectric device including: a stress removing electrode formed on a substrate; a stress removing piezoelectric layer formed on the stress removing electrode; and a drive layer having a pair of drive electrodes and a piezoelectric layer disposed between the pair of drive electrodes, the drive layer being divided in a plurality of drive portions and a plurality of non-drive portions by grooves which reach the stress removing piezoelectric layer; and a channel plate jointed to the piezoelectric device on a side where the drive layer is formed, and having a plurality of discrete ink channels formed in parts thereof respectively opposed to said plural drive portions, corresponding to nozzles for jetting ink.

In the above-described ink jet printer head, it is possible that the drive electrode and/or the stress removing electrode has all region thereof or a part of the region formed in a mesh.

In the above-described ink jet printer head, it is possible that a prescribed voltage is applied between the lowermost drive electrode and the stress removing electrode when the drive portions are driven to thereby mitigate a stress exerted to the stress removing piezoelectric layer.

In the above-described ink jet printer head, it is possible that a voltage to be applied to the drive electrode and a voltage to be applied to the stress removing electrode have equipotential.

The above-described object is also achieved by an ink jet printer head comprising: a piezoelectric device formed on a substrate, and including a drive layer having a pair of drive electrodes and a piezoelectric layer disposed between the pair of drive electrodes, the drive layer being divided in a plurality of drive portions and non-drive portions by grooves which reach the substrate; and a channel plate jointed to the piezoelectric device on a side where the drive layer is formed, and having a plurality of discrete ink channels formed in parts thereof respectively opposed to said plural drive portions, corresponding to nozzles for jetting ink, the non-drive portions having all regions thereof or parts of the regions where the drive electrodes are not formed.

The above-described object is also achieved by an ink jet printer head comprising: a piezoelectric device formed on a substrate, and including a drive layer having a pair of drive electrodes and a piezoelectric layer disposed between the pair of drive electrodes, the drive layer being divided in a plurality of drive portions and non-drive portions by grooves which reach the substrate; and a channel plate jointed to the piezoelectric device on a side where the drive layer is formed, and having a plurality of discrete ink channels formed in parts thereof respectively opposed to said plural drive portions, corresponding to nozzles for jetting ink, the drive electrodes have all regions thereof or parts of the region formed in a mesh.

In the above-described ink jet printer head, it is possible that the ink jet printer head further comprises: a stress removing electrode provided inside the substrate lower than the bottoms of the grooves.

In the above-described ink jet printer head, it is possible that the drive layer has a multi-layer structure having a plurality of drive electrodes and a plurality of piezoelectric layers alternately laid one on another.

The above-described object is also achieved by an ink jet printer comprising: an above-described ink jet printer head; an ink supply means for supplying ink to the discrete ink channels; and a voltage applying means for applying a voltage to the drive electrodes to displace the drive portions, whereby the drive portions are displaced by the voltage applying means to press the ink in the discrete ink channels introduced by the ink supply means so as to jet the ink through the nozzles.

DETAILED DESCRIPTION OF THE INVENTION

[A First Embodiment]

Figure 1:
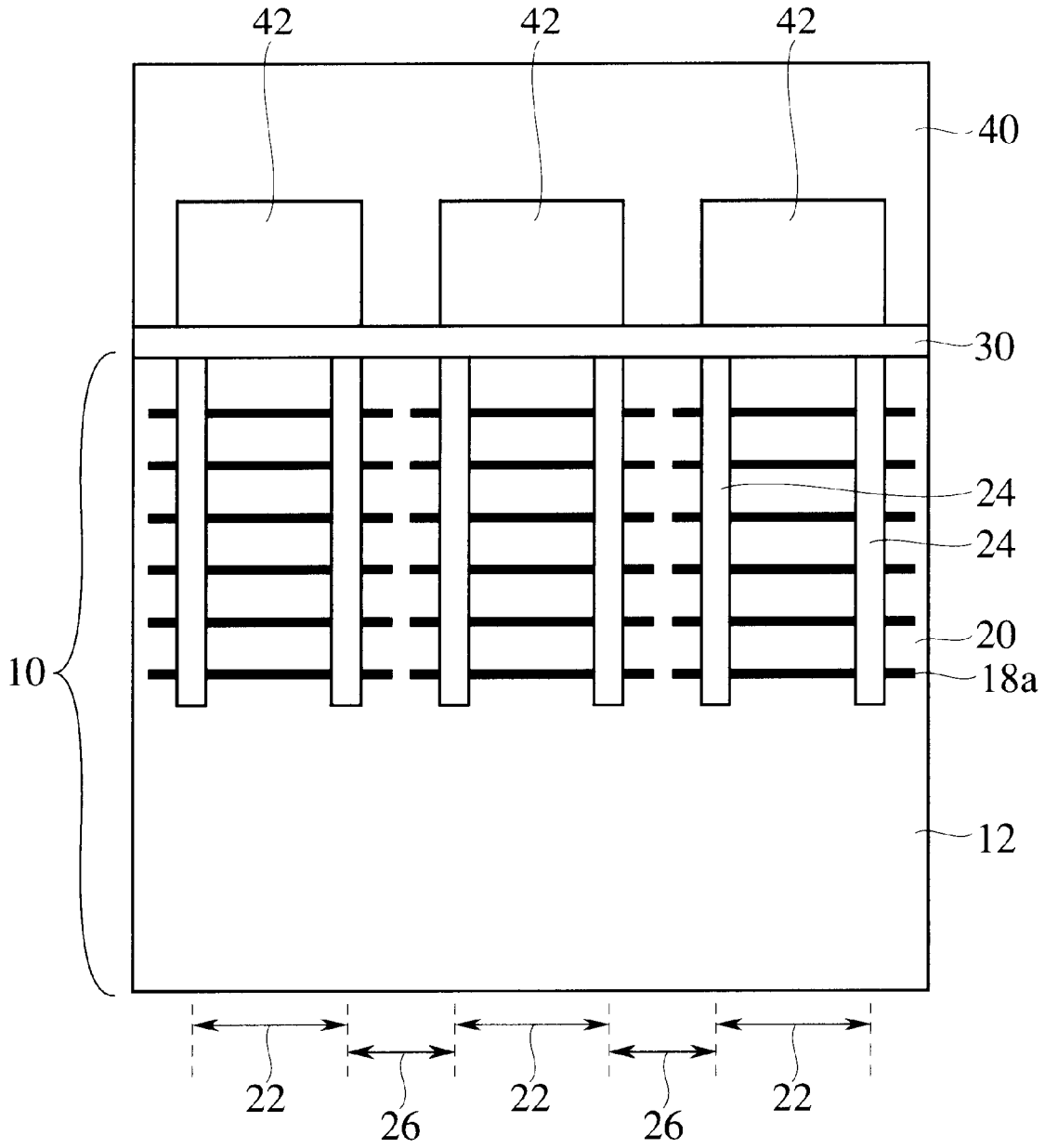
FIG. 1 is a diagrammatic sectional view of the ink jet printer head and the ink jet printer according to a first embodiment of the present invention, which shows a structure thereof.

The ink jet printer head and the ink jet printer according to a first embodiment of the present invention will be explained with reference to FIG. 1. FIG. 1 is a diagrammatic sectional view of the ink jet printer head and the ink jet printer according to the present embodiment, which shows a structure thereof.

A plurality of drive electrodes 18*a* and a plurality of piezoelectric layers 20 forming drive layers are alternately laid one on another on an insulation substrate 12 of ceramics. Grooves 24 are formed in the thus-formed drive layers and separate adjacent drive portions 22 from each other for high displacement efficiency. The grooves 24 are formed down to the insulation substrate 12. Thus, a piezoelectric device 10 having a plurality of drive portions 22 separated by the grooves 24 is formed. A channel plate 40 having discrete ink channels 42 respectively associated with nozzles for jetting ink formed in is connected to the upper part of the piezoelectric device 10 by a junction layer 30. The ink jet printer head according to the present embodiment is thus constituted.

The ink jet printer head according to the present embodiment is characterized in that, as shown in FIG. 1, each non-drive portion 26 has a region where the drive electrodes 20 are not formed all or partially over a width of the non-drive portion 26.

A region where the drive electrodes 18*a* are absent is provided in each non-drive region 26, whereby the piezoelectric layers 20 formed through the drive electrodes 18*a* can have good adhesion to each other, and the non-drive portion 26 can have higher rigidity in the direction of displacement of the drive portion 22. Accordingly, a displacement amount of the non-drive portion 26 accompanying drive of the drive portion 22 can be small, and a loss of pressure applied to the associated ink channel 42 can be small. Peripheral parts of the drive electrodes 18*a* can have high mechanical strength, whereby the drive electrodes 18*a* and the piezoelectric layers 20 are prevented from peeling off each other in processing the grooves 24 and while driving (see Example 1).

The junction layer 30 connecting the piezoelectric device 10 and the channel plate 40 may be formed of a resin, as of PET, dry film resist, epoxy, polyimide, ABS or others. The junction layer 30 can have higher rigidity by adding a filler of an inorganic material to the resin, whereby the loss of pressure applied to the respective ink channels 42 can be further decreased.

As described above, according to the present embodiment, a region where the drive electrodes 18*a* are not formed is provided in each of the non-drive portions 26 all or partially over a width thereof, whereby adhesion between the drive electrodes 18*a* and the piezoelectric layers 20 can be high. Accordingly, the ink jet printer head can have higher reliability.

[A Second Embodiment]

Figure 2:
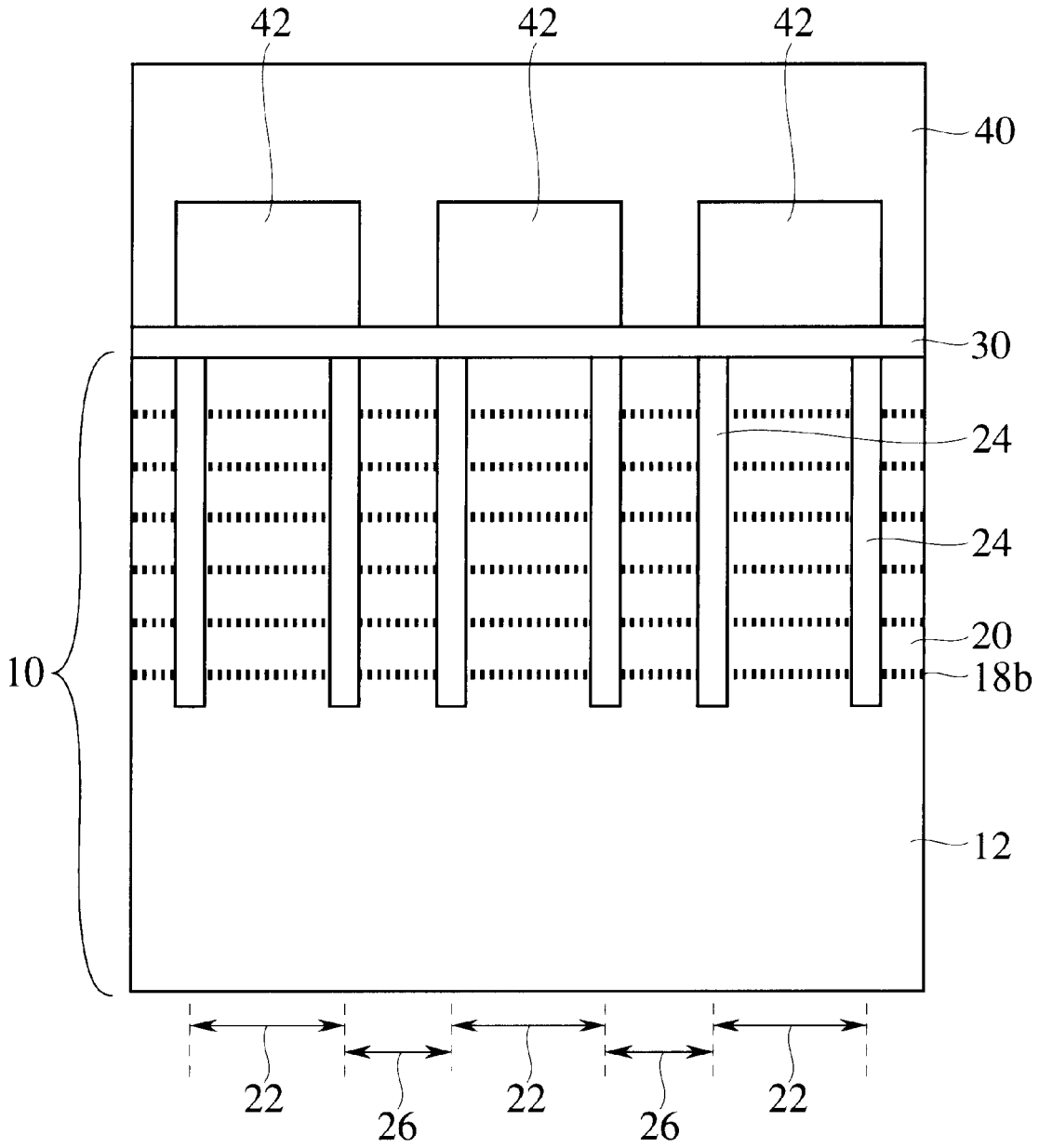
FIG. 2 is a diagrammatic sectional view of the ink jet printer head and the ink jet printer according to a second embodiment of the present invention, which shows a structure thereof.
Figure 3:
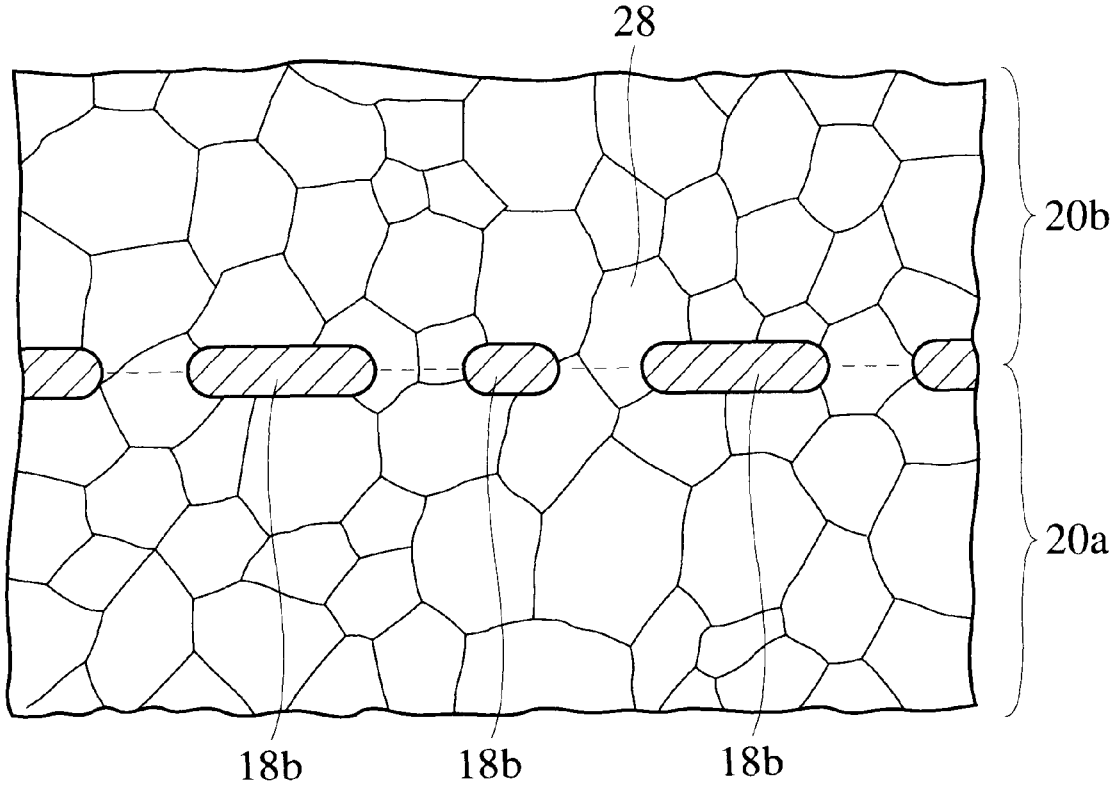
FIG. 3 is an enlarged view of a vicinity of the drive electrode of the ink jet printer head according to the second embodiment of the present invention.

The ink jet printer head and the ink jet printer according to a second embodiment of the present invention will be explained with reference to FIGS. 2 and 3. FIG. 2 is a diagrammatic sectional view of the ink jet printer head and the ink jet printer according to the present embodiment, which shows a structure thereof. FIG. 3 is an enlarged view of peripheral parts of the drive electrodes of the ink jet printer head according to the present embodiment.

A plurality of drive electrodes 18*b* and a plurality of piezoelectric layers 20 forming drive layers are laid alternately one on another on an insulation substrate 12 of ceramics. Grooves 24 are formed in the thus-formed drive layers, for isolating respective drive portions 22 form their neighboring ones for high displacing efficiency. The grooves 24 are formed down to the insulation substrate 12. Thus, a piezoelectric device 10 having a plurality of the drive portions 22 divided by the grooves 24 is formed. A channel plate 40 with discrete ink channels 42 formed in, respectively associated with nozzles for jetting ink is jointed to the upper surface of the piezoelectric device 10 by a junction layer 30. Thus the ink jet printer head according to the present embodiment is formed.

The ink jet printer head according to the present embodiment is characterized in that, as shown in FIG. 2, the drive electrodes 18*b* are not formed in layers but formed in meshes. The thus formed drive electrodes 18*b* permit the piezoelectric layers 20 sandwiching the drive electrodes 18*b* to be continuous through the openings of the meshes, whereby the peripheral parts of the drive electrode 18*b* can have high mechanical strength. That is, as shown in FIG. 3, in the piezoelectric layer 20*a* and the piezoelectric layer 20*b* formed with the mesh-shaped drive electrode 18*b* sandwiched therebetween ceramic crystal grains 28 are formed continuous to one another without joints among the crystal structures.

Accordingly, although the piezoelectric layers 20 are formed through the drive electrodes 18*b*, the peripheral parts of the drive electrodes 18*b* can have high mechanical strength. The peeling between the drive electrodes 18*b* and the piezoelectric layers 20 can be depressed in processing the grooves 24 and driving (see Example 2).

As described above, according to the present embodiment, the drive electrodes 18*b* are formed in meshes, whereby adhesion between the piezoelectric layers 20 formed through the drive electrodes 18*b* can be high, and accordingly the ink jet printer head can have high reliability.

In the present embodiment, the drive electrodes 18*b* are formed in meshes but may not be essentially formed in meshes. That is, it is important to the ink jet printer head according to the present embodiment that the piezoelectric layers formed with the drive electrodes sandwiched therebetween have regions continuous to one another, and the continuity does not rely on a pattern of the drive electrodes. The drive electrodes may be formed in, e.g., stripes.

As in the ink jet printer head according to the first embodiment, regions where the drive electrodes are not formed may be formed in the entire or parts of non-drive portions 26, whereby the ink jet printer head can have higher reliability.

[A Third Embodiment]

Figure 4:
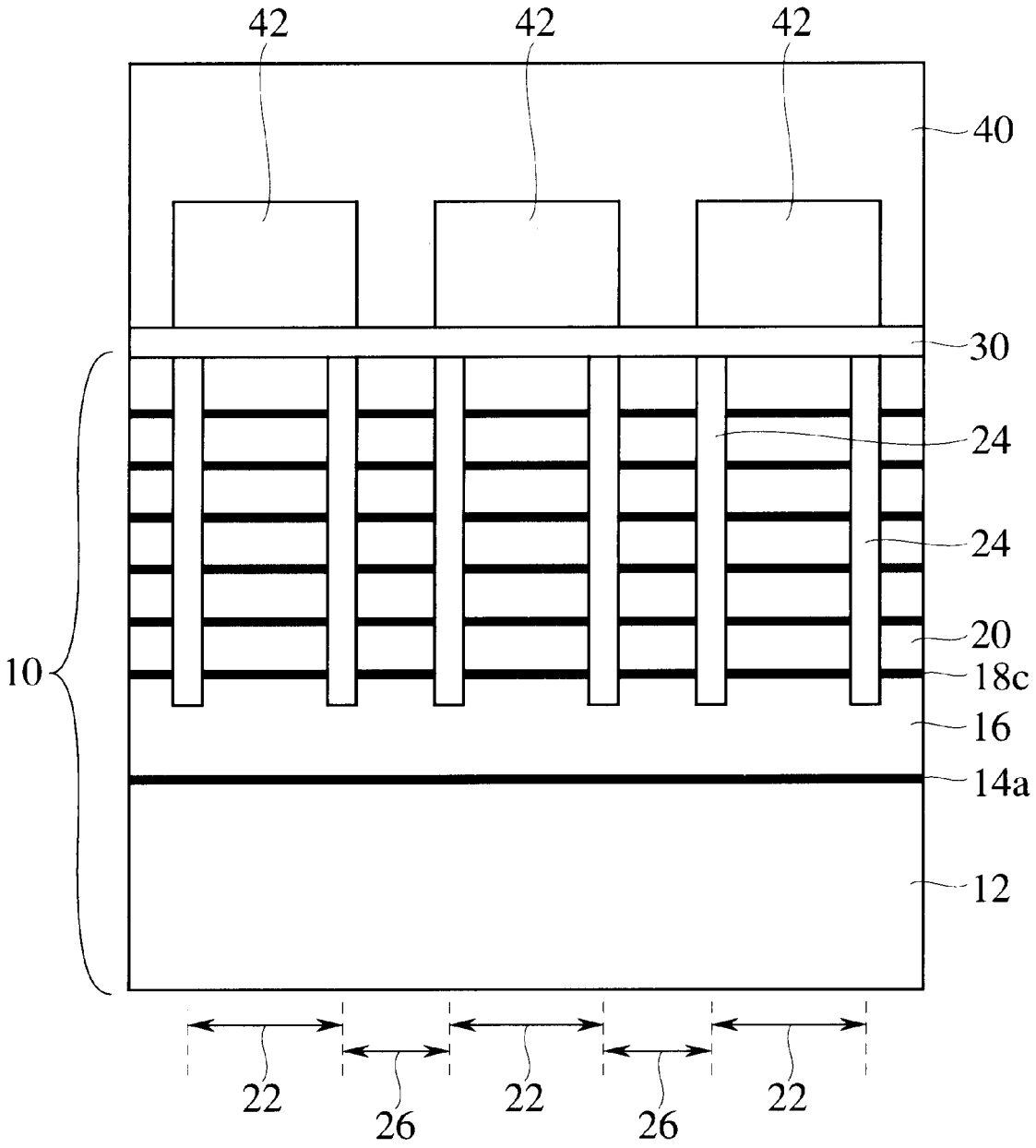
FIG. 4 is a diagrammatic sectional view of the ink jet printer head and the ink jet printer according to a third embodiment of the present invention, which shows a structure thereof.

The ink jet printer head and the ink jet printer according to a third embodiment of the present invention will be explained with reference to FIG. 4. FIG. 4 is a diagrammatic sectional view of the ink jet printer head and the ink jet printer according to the present embodiment, which shows a structure thereof.

A stress removing electrode 14*a* is formed on an insulation substrate 12 of ceramics. A stress removing piezoelectric layer 16 is formed on the insulation substrate 12 with the stress removing electrode 14*a* formed on. A plurality of drive electrodes 18*c* and a plurality of piezoelectric layers 20 forming drive layers are laid alternately one on another. Grooves 24 for isolating drive portions 22 from the respective adjacent ones for high replacing efficiency are formed in the thus-formed drive layers. The grooves 24 are formed down to the stress removing piezoelectric layer 16. Thus a piezoelectric device 10 having a plurality of the drive portions 22 divided by the grooves 24 is formed. A channel plate 40 with discrete ink channels 42 formed in, respectively associated with nozzles for jetting ink is jointed to the upper surface of the piezoelectric device 10 by a junction layer 30. Thus, the ink jet printer head according to the present embodiment is formed.

The ink jet printer head according to the present embodiment is characterized in that the stress removing electrode 14*a* is provided below the forward end of the grooves 24 to thereby decrease a stress immediately below the drive portions 22 and that of the forward ends of the grooves 24 due to displacement of the drive portions 22, whereby crosstalk is decreased, and the piezoelectric device 10 can have higher reliability.

Usually, when a stress is generated in a piezoelectric material, a potential is generated in the stress portion due to the piezoelectric effect. Accordingly, a prescribed voltage is applied to between the lowermost drive electrode 18*c* of the drive portions 22 and the stress removing electrode 14*a* to thereby cancel a potential generated by a stress, whereby a stress immediately below the drive portions 22 and that of the forward ends of the grooves 24 can be decreased. Thus, the ink jet printer head can have high reliability (see Example 3).

It is preferable that a voltage to be applied to between the lowermost electrode 18*c* of the drive portions 22 and the stress removing electrode 14*a* is set suitably corresponding to a stress generated immediate below the drive portions 22 and that of the forward ends of the grooves 24 generated by displacement of the drive portions 22, but a stress can be mitigated also by setting the lowermost drive electrode 18*c* of the drive portions 22 and the stress removing electrode 14*a* at the same potential (e.g., the ground potential).

As described above, according to the present embodiment, the stress removing electrode 14*a* is formed below the forward ends of the grooves 24 to remove a stress generated immediately below the drive portions 22 and that of the forward ends of the grooves 24 generated by displacement of the drive portions 22, whereby crosstalk between the drive portions 22 and their adjacent one can be decreased. Stress exerted to the forward ends of the grooves 24 can be mitigated, whereby the ink jet printer head can have high reliability.

In the present embodiment, the stress removing electrode 14*a* is provided immediately below the drive portions 22 and the non-drive portions 26, but the stress removing electrode 14*a* may be formed only immediately below the drive portions 22. Because a stress is mainly generated immediately below the drive portions 22 during a drive, the advantageous effect of the present embodiment can be achieved by forming the stress removing electrode 14*a* immediately below at least the drive portions 22.

[A Fourth Embodiment]

Figure 5:
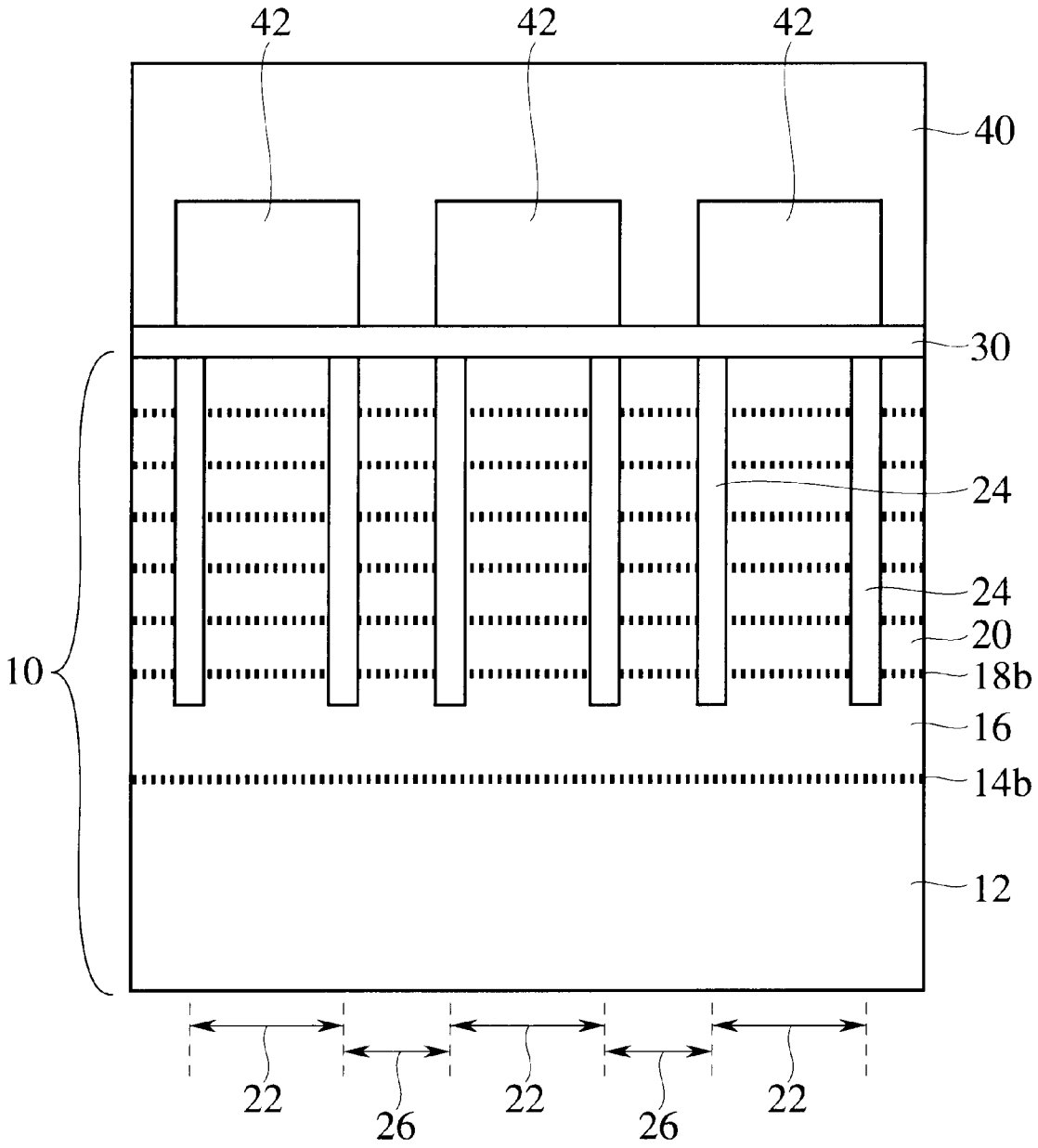
FIG. 5 is a diagrammatic sectional view of the ink jet printer head and the ink jet printer according to a fourth embodiment of the present invention, which shows a structure thereof.

The ink jet printer head and the ink jet printer according to a fourth embodiment of the present invention will be explained with reference to FIG. 5. FIG. 5 is a diagrammatic sectional view of the ink jet printer head and the ink jet printer according to the present embodiment, which shows a structure thereof.

The ink jet printer head according to the present embodiment is characterized in that the ink jet printer head according to the second embodiment includes a mesh-shaped stress removing electrode 14*b*.

That is, the mesh-shaped stress removing electrode 14*b* is provided on an insulation substrate 12 of ceramics. A stress removing piezoelectric layer 16 is formed on the insulation substrate 12 with the stress removing electrode 14*b* formed on. A plurality of mesh-shaped drive electrodes 18*b* and a plurality of piezoelectric layers 20 are laid alternately one on another on the stress removing piezoelectric layer 16. Grooves 24 are formed in the thus-formed drive layers, for isolating drive portions 22 from the respective adjacent ones for high displacement efficiency. The grooves 24 are formed down to the stress removing piezoelectric layer 16. Thus, a piezoelectric device 10 having the drive portions 22 divided by the grooves 24 is formed. A channel plate 40 with discrete ink channels 42 formed in, corresponding to respective nozzles for jetting ink is jointed to the upper surface of the piezoelectric device 10 by a junction layer 30. Thus, the ink jet printer head according to the present embodiment is formed.

The ink jet printer head is thus constituted, whereby high adhesion between the piezoelectric layers 16, 20 formed through the electrodes 14*b*, 18*b* can be obtained as can be obtained in the second embodiment, and, as can be in the third embodiment, a stress immediately below the drive portions and a stress of the forward ends of the grooves 24 generated by displacement of the drive portions 22 can be reduced (see Example 4).

As described above, according to the present embodiment, the stress removing electrode 14*b* is provided below the forward ends of the grooves 24, and the stress removing electrode 14*b* and the drive electrodes 18*b* are mesh-shaped, whereby a stress immediately below the drive portions and a stress of the forward ends of the grooves 24 generated by displacement of the drive portions 22 can be reduced, and adhesion between the piezoelectric layers can be increased. Accordingly, cross-talk between the drive portions 22 and their adjacent ones can be reduced. Peeling of the piezoelectric layers 20 and the electrodes from each other can be suppressed, whereby the ink jet printer head can have high reliability.

In the present embodiment, the stress removing electrode 14*b* is mesh-shaped but may be solid as in the ink jet printer head according to the third embodiment. A pattern of the stress removing electrode is not essentially a mesh but may be, e.g., a stripe.

[A Fifth Embodiment]

Figure 6:
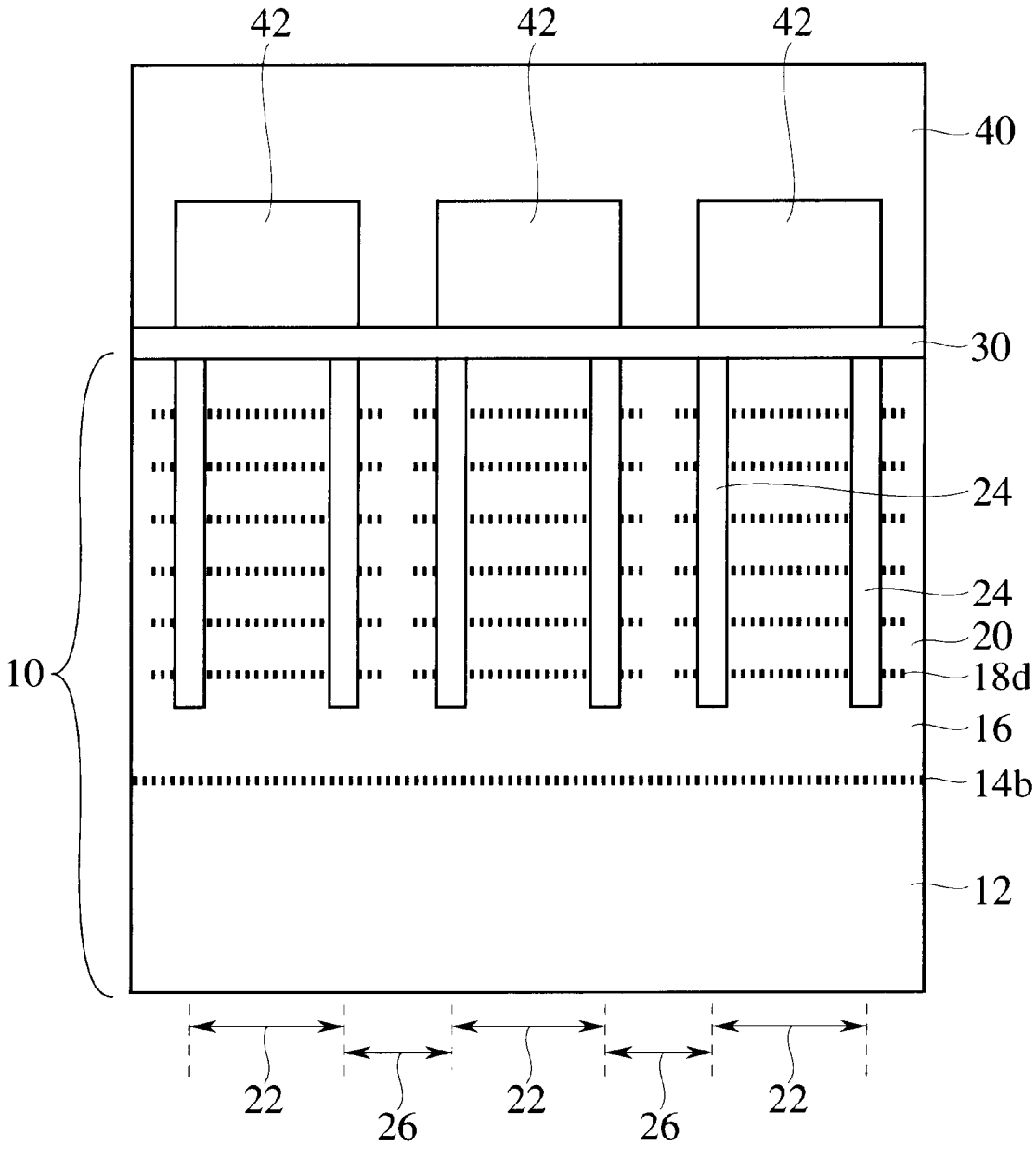
FIG. 6 is a diagrammatic sectional view of the ink jet printer head and the ink jet printer according to a fifth embodiment of the present invention, which shows a structure thereof.

The ink jet printer head and the ink jet printer according to a fifth embodiment of the present invention will be explained with reference to FIG. 6. FIG. 6 is a diagrammatic sectional view of the ink jet printer head and the ink jet printer according to the present embodiment, which shows a structure thereof.

The ink jet printer head according to the present embodiment is characterized in that the ink jet printer head according to the fourth embodiment includes regions where the drive electrodes are not formed along an entire width or a part of the width of the non-drive portions 26.

That is, a mesh-shaped stress removing electrode 14*b* is formed on an insulation substrate 12 of ceramics. A stress removing piezoelectric layer 16 is formed on the insulation substrate 12 with the stress removing electrode 14*b* formed on. On the stress removing piezoelectric layer 16 there are alternately laid one on another a plurality of drive electrodes 18*d* formed in meshes and having regions where the drive electrodes 18*d* are not formed along an entire width or a part of the width of the non-drive portions 26, and a plurality of piezoelectric layers 20. Grooves 24 are formed in the thus-formed drive layers, for isolating the drive portions 22 from their respective ones for high displacement efficiency. The grooves 24 are formed down to the stress removing piezoelectric layer 16. Thus, a piezoelectric device 10 having a plurality of drive portions 22 divided by the grooves 24 is formed. A channel plate 40 with discrete ink channels 42 formed respectively associated with nozzle for jetting ink is jointed to the upper surface of the piezoelectric device 10 by a junction layer 30. Thus, the ink jet printer head according to the present embodiment is constituted.

The ink jet printer head is thus constituted, whereby adhesion between the piezoelectric layers formed through the electrode can be high as can be in the first and the fourth embodiments, and as can be in the third embodiment, a stress immediately below the drive portions generated by displacement of the drive portions and a stress of the forward ends of the grooves can be decreased (see Example 5).

As described above, according to the present embodiment, the stress removing electrode 14*b* is provided below the forward ends of the grooves 24, the stress removing electrode 14*b* and the drive electrodes 18*d* are formed in meshes, and the regions where the drive electrodes 18*d* are not formed along an entire width or a part of the width of the non-drive portions 26, whereby a stress immediately below the drive portions 22 and a stress of the forward ends of the grooves 24 generated by displacement of the drive portions 22 can be decreased, and adhesion between the piezoelectric layers 20 can be high. Accordingly crosstalk between the drive portions 22 and their adjacent ones can be decreased. Peeling of the piezoelectric layers 20 and the electrodes from each other can be suppressed, and the ink jet printer head can have high reliability. The non-drive portions 26 has the regions without the drive electrodes 18*d* formed in are formed, whereby losses of a pressure applied to the ink channels 42 can be reduced.

In the present embodiment, the stress removing electrode 14*b* is mesh-shaped but may be formed in the stress removing electrode 14*a*, which is solid, as in the ink jet printer head according to the third embodiment. A pattern of the stress removing electrode is not essentially mesh-shaped but may be, e.g., stripe-shaped.

In the first to the fifth embodiments, the drive layers are formed by laying the five piezoelectric layers 20 one on another respectively through the drive electrode 18, but a number of the piezoelectric layers 20 forming the drive layers is not limited to that of the present embodiment and may be at least 1.

[A Sixth Embodiment]

Figure 7:
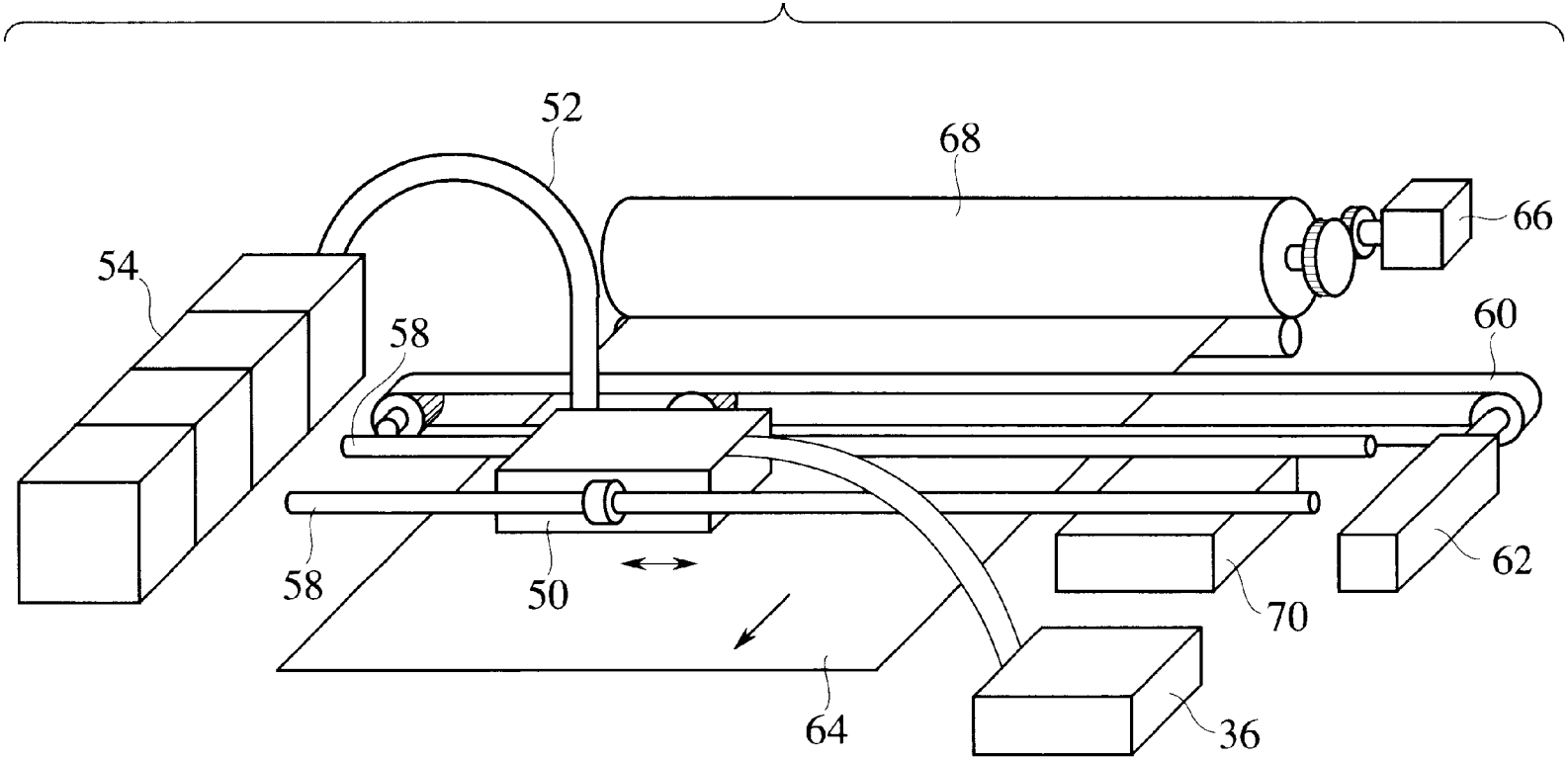
FIG. 7 is a diagrammatic sectional view of the ink jet printer according to a seventh embodiment of the present invention, which shows a structure thereof.
Figure 8:
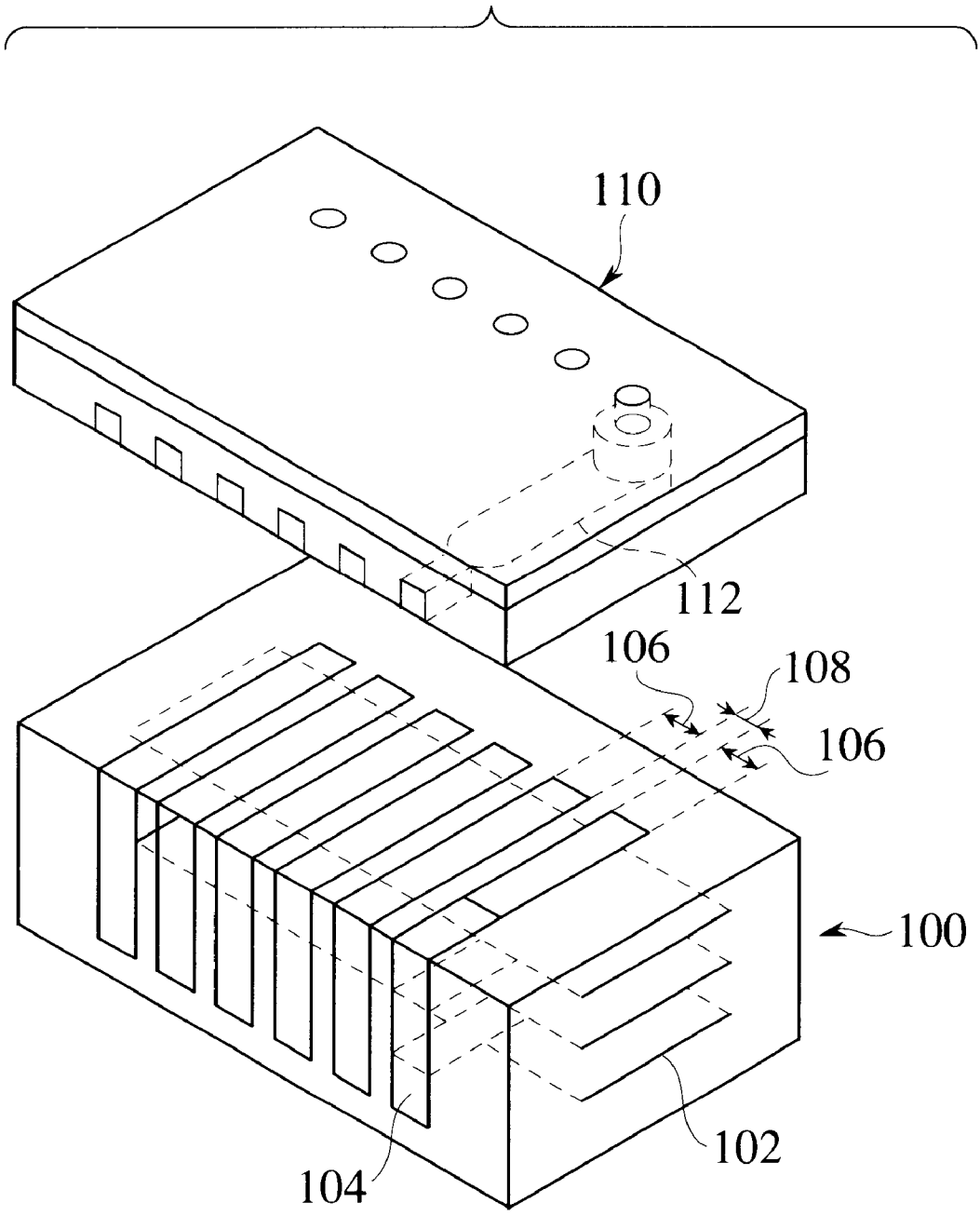
FIG.8 PRIOR ART
FIG. 8 is a diagrammatic view of the first conventional ink jet printer head, which shows the structure thereof.

The ink jet printer according to a sixth embodiment of the present invention will be explained with reference to FIG. 7. FIG. 7 is a diagrammatic view of the ink jet printer according to the present embodiment, which shows a structure thereof.

The present embodiment shows one example of the ink jet printer head according to the first to the fifth embodiments shown in FIGS. 1 to 6 applied to an ink jet printer.

First, the structure of the ink jet printer according to the present embodiment will be explained with reference to FIG. 7.

An ink tank 54 is connected to the ink jet printer head 50 by a tube 52 to feed ink to the discrete ink channels 42 of the ink jet head printer 50. The ink jet printer head 50 is connected to a driver 56 for applying a voltage to the drive electrodes 18*a*, 18*b*, 18*c*, or 18*d* of required drive portions 22.

The ink jet printer head 50 is supported by a pair of juxtaposed guide rails 58 and is movable in the direction of extension of the guide rails 58. The ink jet printer head 50 is secured to a belt 60 disposed parallel with the guide rails 58. The ink jet printer head 50 is moved left and right along the guide rails 58 by a head displacing motor 62 for driving the belt 60.

A recording paper 64 is placed on the side of the ink jet printer head 50 where nozzles are provided. The recording paper 64 is moved perpendicularly to the directions of displacement of the ink jet printer head 50 by a paper feed roller 68 driven by a paper feed motor driver 66.

A backup unit 70 is disposed near the end of the guide rails 58. The backup unit 70 puts caps on the nozzles of the ink jet printer head 50 and cleans for removing clogging of the nozzles, etc when the head is not used.

Then, the operation of the ink jet printer according to the present embodiment will be explained.

First, ink is fed to the discrete ink channels 42 of the ink jet printer head 50 from the ink tank 54 through the tube 52.

Then, the nozzles of the ink jet printer head are moved to arbitrary positions of the recording paper 64 to which the ink is to be jetted.

Then, a drive voltage is applied to the drive electrodes 18 of required drive portions 22 of the ink jet printer head 50 to displace the required drive portions 22 to press the ink in the associated discrete ink channels 42. Thus, the ink is jetted from the nozzles connected to the discrete ink channels 42 associated with the required drive portions 22 and adheres to the recording paper 64.

Then, the ink is repeatedly jetted by the above-described means while the ink jet printer head 50 and the recording paper 64 are being displaced. Thus, required images are printed on the recording paper 64.

After the printing is over, the ink jet printer head 50 is displaced onto the backup unit 70. The cleaning is performed there as required.

Thus, the ink jet printer can have, e.g., a 1800 dpi printing accuracy and a 5 ppm printing speed for A4 size.

As described above, according to the present embodiment, the ink jet printer head according to the first to the fifth embodiments is used, whereby the ink jet printer can have small crosstalk, and high reliability and high performance.

EXAMPLES

Example 1

An piezoelectric device having the sectional structure shown in FIG. 1 was fabricated, using PZT as a piezoelectric material, and Ag/Pd as an electrode material. The piezoelectric layers of the drive layer were 6 layers, and a number of the nozzles were 100.

Then, a resinous channel plate having 100 discrete ink channels, and a nozzle plate of SUS having 100 discrete 30 μm-diameter nozzle orifices were connected by press to the piezoelectric device.

Then, the piezoelectric device with the resinous channel plate and the nozzle plate connected to are furnished with the ink supply system and wires, and the ink jet printer head was fabricated.

Cross-talk was evaluated on the thus-fabricated ink jet printer head. An evaluation result was that a particle amount change (cross-talk) and a particle velocity change were about 10% and about 12% between a single nozzle drive and a 100 nozzles simultaneous drive.

A result of a continuous drive test was that one of the nozzles could not jet ink after drive of one billion pulses. The ink jet printer head was disassembled and inspected, and the defective nozzle had cracks in the forward portion of the groove.

A yield of processing the grooves in fabricating the piezoelectric device was 100%.

Example 2

A piezoelectric device having the sectional structure shown in FIG. 2 was fabricated, using PZT as a piezoelectric material, and Ag/Pd as an electrode material. The piezoelectric layers of the drive layer were 6 layers, and a number of the nozzles were 100.

Then, a resinous channel plate having 100 discrete ink channels, and a nozzle plate of SUS having 100 discrete 30 μm-diameter nozzle orifices were connected by press to the piezoelectric device.

Then, the piezoelectric device with the resinous channel plate and the nozzle plate connected to are furnished with the ink supply system and wires, and the ink jet printer head was fabricated.

Cross-talk was evaluated on the thus-fabricated ink jet printer head. An evaluation result was that a particle amount change (cross-talk) and a particle velocity change were about 10% and about 12% between a single nozzle drive and a 100 nozzles simultaneous drive.

A result of a continuous drive test was that one of the nozzles could not jet ink after drive of one billion pulses. The ink jet printer head was disassembled and inspected, and the defective nozzle had cracks in the forward portion of the groove.

A yield of processing the grooves in fabricating the piezoelectric device was 100%.

Example 3

A piezoelectric device having the sectional structure shown in FIG. 4 was fabricated, using PZT as a piezoelectric material, and Ag/Pd as an electrode material. The piezoelectric layers of the drive layer were 6 layers, and a number of the nozzles were 100.

Then, a resinous channel plate having 100 discrete ink channels, and a nozzle plate of SUS having 100 discrete 30 μm-diameter nozzle orifices were connected by press to the piezoelectric device.

Then, the piezoelectric device with the resinous channel plate and the nozzle plate connected to are furnished with the ink supply system and wires, and the ink jet printer head was fabricated.

Cross-talk was evaluated on the thus-fabricated ink jet printer head. An evaluation result was that a particle amount change (cross-talk) and a particle velocity change were about 5% and about 3% between a single nozzle drive and a 100 nozzles simultaneous drive.

A result of a continuous drive test was that one of the nozzles could not jet ink after drive of 2 billion pulses. The ink jet printer head was disassembled and inspected, and the defective nozzle had cracks around the drive electrodes in the non-driven portions.

A yield of processing the grooves in fabricating the piezoelectric device was 70%. The cause for all the defects was peeling of the electrode layers from the piezoelectric layers.

Example 4

A piezoelectric device having the sectional structure shown in FIG. 5 was fabricated, using PZT as a piezoelectric material, and Ag/Pd as an electrode material. The piezoelectric layers of the drive layer were 6 layers, and a number of the nozzles were 100.

Then, a resinous channel plate having 100 discrete ink channels, and a nozzle plate of SUS having 100 discrete 30 μm-diameter nozzle orifices were connected by press to the piezoelectric device.

Then, the piezoelectric device with the resinous channel plate and the nozzle plate connected to are furnished with the ink supply system and wires, and the ink jet printer head was fabricated.

Cross-talk was evaluated on the thus-fabricated ink jet printer head. An evaluation result was that a particle amount change (cross-talk) and a particle velocity change were about 5% and about 3% between a single nozzle drive and a 100 nozzles simultaneous drive.

A result of a continuous drive test was that an ink particle velocity lowered in one of the nozzles after drive of 5 billion pulses and lowered in three of the nozzles after 10 billion pulses. The ink jet printer head was disassembled and inspected, and the defective nozzles had cracks around the drive electrodes in the non-driven portions.

A yield of processing the grooves in fabricating the piezoelectric device was 100%.

Example 5

A piezoelectric device having the sectional structure shown in FIG. 6 was fabricated, using PZT as a piezoelectric material, and Ag/Pd as an electrode material. The piezoelectric layers of the drive layer were 6 layers, and a number of the nozzles were 100.

Then, a resinous channel plate having 100 discrete ink channels, and a nozzle plate of SUS having 100 discrete 30 μm-diameter nozzle orifices were connected by press to the piezoelectric device.

Then, the piezoelectric device with the resinous channel plate and the nozzle plate connected to are furnished with the ink supply system and wires, and the ink jet printer head was fabricated.

Cross-talk was evaluated on the thus-fabricated ink jet printer head. An evaluation result was that a particle amount change (cross-talk) and a particle velocity change were about 5% and about 3% between a single nozzle drive and a 100 nozzles simultaneous drive.

A result of a continuous drive test was that even after 10 billion pulses, all the 100 nozzles jetted ink. Changes of a particle amount and particle velocity were within ±10% of those before the test, and cross-talk did not change.

A yield of processing the grooves in fabricating the piezoelectric device was 100%.

Control

Figure 9:
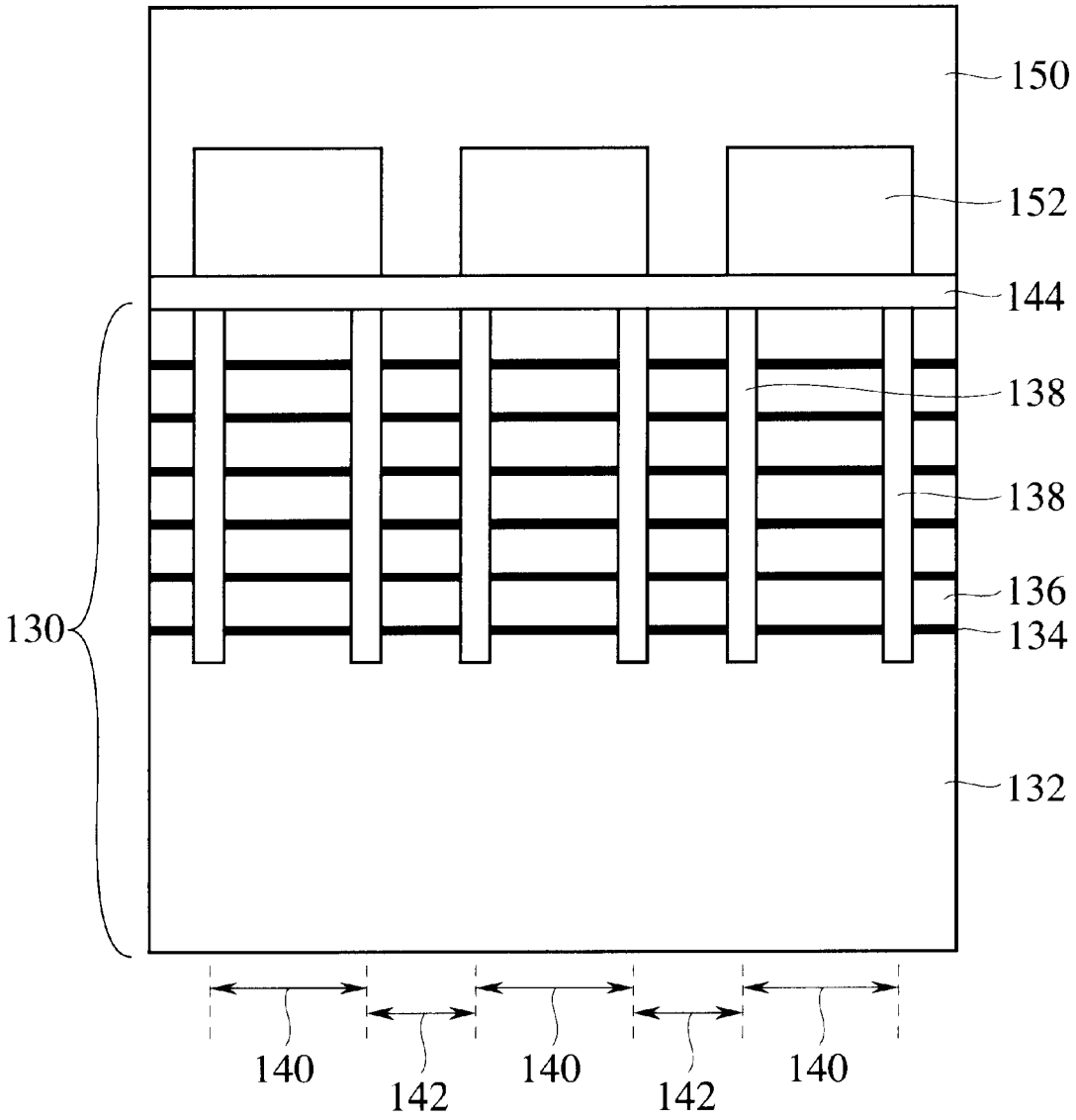
FIG.9 PRIOR ART
FIG. 9 is a diagrammatic view of the second conventional ink jet printer head, which shows the structure thereof.

A piezoelectric device having the sectional structure shown in FIG. 9 was fabricated, using PZT as a piezoelectric material, and Ag/Pd as an electrode material. The piezoelectric layers of the drive layer were 6 layers, and a number of the nozzles were 100.

Then, a resinous channel plate having 100 discrete ink channels, and a nozzle plate of SUS having 100 discrete 30 μm-diameter nozzle orifices were connected by press to the piezoelectric device.

Then, the piezoelectric device with the resinous channel plate and the nozzle plate connected to are furnished with the ink supply system and wires, and the ink jet printer head was fabricated.

Cross-talk was evaluated on the thus-fabricated ink jet printer head. An evaluation result was that a particle amount change (cross-talk) and a particle velocity change were about 10% and about 12% between a single nozzle drive and a 100 nozzles simultaneous drive.

A result of a continuous drive test was that one of the nozzles could not jet ink after drive of one billion pulses. The ink jet printer head was disassembled and inspected, and the defective nozzle had cracks in the forward portion of the groove.

A yield of processing the channels in fabricating the piezoelectric device was 70%. The cause for all the defects was peeling of the electrode layers from the piezoelectric layers.

What is claimed is:

1. An ink jet printer head comprising:

a piezoelectric device including:

a stress removing electrode formed on a substrate;

a stress removing piezoelectric layer formed on the stress removing electrode; and a drive layer having a pair of drive electrodes and a piezoelectric layer disposed between the pair of drive electrodes, the drive layer being divided in a plurality of drive portions and a plurality of non-drive portions by grooves which reach the stress removing piezoelectric layer; and a channel plate joined to the piezoelectric device on a side where the drive layer is formed, and having a plurality of discrete ink channels formed in parts thereof respectively opposed to said plural drive portions, corresponding to nozzles for jetting ink, a prescribed voltage being applied between the lowermost drive electrode and the stress removing electrode when the drive portions are driven to thereby mitigate a stress exerted to the stress removing piezoelectric layer.

2. An ink jet printer head according to claim 1, wherein the drive electrode and/or the stress removing electrode has all region thereof or a part of the region formed in a mesh.

3. An ink jet printer head according to claim 2, wherein a prescribed voltage is applied between the lowermost drive electrode and the stress removing electrode when the drive portions are driven to thereby mitigate a stress exerted to the stress removing piezoelectric layer substrate lower than the bottoms of the grooves.

4. An ink jet printer head according to claim 3, wherein a voltage to be applied to the lowermost drive electrode and a voltage to be applied to the stress removing electrode have equipotential.

5. An ink jet printer head according to claim 2, wherein the drive layer has a multi-layer structure having a plurality of drive electrodes and a plurality of piezoelectric layers alternately laid one on another.

6. An ink jet printer head according to claim 1, wherein a voltage to be applied to the lowermost drive electrode and a voltage to be applied to the stress removing electrode have equipotential.

7. An ink jet printer head according to claim 1, wherein the drive layer has a multi-layer structure having a plurality of drive electrodes and a plurality of piezoelectric layers alternately laid one on another.

8. An ink jet printer comprising:

an ink jet printer head according to claim 1;

an ink supply means for supplying ink to the discrete ink channels; and a voltage applying means for applying a voltage to the drive electrodes to displace the drive portions, whereby the drive portions are displaced by the voltage applying means to press the ink in the discrete ink channels introduced by the ink supply means so as to jet the ink through the nozzles.

9. An ink jet printer head comprising:

a piezoelectric device formed on a substrate, and including a drive layer having a pair of drive electrodes and a piezoelectric layer disposed between the pair of drive electrodes, the drive layer being divided in a plurality of drive portions and non-drive portions, each defined by a pair of grooves which reach the substrate; and a channel plate joined to the piezoelectric device on a side where the drive layer is formed, and having a plurality of discrete ink channels formed in parts thereof respectively opposed to said plural drive portions, corresponding to nozzles for jetting ink, the non-drive portions having all regions thereof or parts of the regions where the drive electrodes are not formed.

10. An ink jet printer head according to claim 9, further comprising a stress removing electrode provided inside the substrate lower than the bottoms of the grooves, and a prescribed voltage being applied between the lowermost drive electrode and the stress removing electrode when the drive portions are driven to thereby mitigate a stress exerted to the stress removing piezoelectric layer.

11. An ink jet printer head according to claim 10, wherein the drive layer has a multi-layer structure having a plurality of drive electrodes and a plurality of piezoelectric layers alternately laid one on another.

12. An ink jet printer head according to claim 9, wherein the drive layer has a multi-layer structure having a plurality of drive electrodes and a plurality of piezoelectric layers alternately laid one on another.

13. An ink jet printer comprising:

an ink jet printer head according to claim 9;

an ink supply means for supplying ink to the discrete ink channels; and a voltage applying means for applying a voltage to the drive electrodes to displace the drive portions, whereby the drive portions are displaced by the voltage applying means to press the ink in the discrete ink channels introduced by the ink supply means so as to jet the ink through the nozzles.

14. An ink jet printer head comprising:

a piezoelectric device formed on a substrate, and including a drive layer having a pair of drive electrodes and a piezoelectric layer disposed between the pair of drive electrodes, the drive layer being divided in a plurality of drive portions and non-drive portions, each defined by a pair of grooves which reach the substrate; and a channel plate joined to the piezoelectric device on a side where the drive layer is formed, and having a plurality of discrete ink channels formed in parts thereof respectively opposed to said plural drive portions, corresponding to nozzles for jetting ink, the drive electrodes have all regions thereof or parts of the region formed in a mesh.

15. An ink jet printer head according to claim 14, further comprising a stress removing electrode provided inside the substrate lower than the bottoms of the grooves, and a prescribed voltage being applied between the lowermost drive electrode and the stress removing electrode when the drive portions are driven to thereby mitigate a stress exerted to the stress removing piezoelectric layer.

16. An ink jet printer head according to claim 15, wherein the drive layer has a multi-layer structure having a plurality of drive electrodes and a plurality of piezoelectric layers alternately laid one on another.

17. An ink jet printer head according to claim 14, wherein the drive layer has a multi-layer structure having a plurality of drive electrodes and a plurality of piezoelectric layers alternately laid one on another.

18. An ink jet printer comprising:

an ink jet printer according to claim 8;

an ink supply means for supplying ink to the discrete ink channels; and a voltage applying means for applying a voltage to the drive electrodes to displace the drive portions, whereby the drive portions are displaced by the voltage applying means to press the ink in the discrete ink channels introduced by the ink supply means so as to jet the ink through the nozzles.

* * * * *